US006061869A

United States Patent [19]

Ettes et al.

[11] Patent Number: 6,061,869

[45] Date of Patent: May 16, 2000

[54] VACUUM CLEANER PROVIDED WITH A SUCTION NOZZLE WITH CONTROLLABLE ELECTRICAL DRIVE MEANS

[75] Inventors: Wilhelmus G. M. Ettes, Drachten; Aafje G. Koster, Eindhoven; Frits Last; Fokke R. Voorhorst, both of Drachten, all of Netherlands

[73] Assignee: U.S. Philips Corporation, New York, N.Y.

[21] Appl. No.: 09/131,246

[22] Filed: Aug. 7, 1998

[30] Foreign Application Priority Data

Aug. 11, 1997 [EP] European Pat. Off. ..... 97202473

[51] Int. Cl.[7] ..... A47L 9/32; A47L 9/28

[52] U.S. Cl. ..... 15/340.2; 15/319; 15/339; 180/19.3

[58] Field of Search ..... 15/319, 339, 340.2; 180/19.2, 19.3

[56] References Cited

U.S. PATENT DOCUMENTS 3,218,876 11/1965 Berger ..... 15/340.2
3,854,164 12/1974 Schmitz ..... 15/340.2
5,285,550 2/1994 Meyer et al. ..... 15/340.2
5,504,971 4/1996 McCormick ..... 15/340.2

*Primary Examiner*—Theresa T. Snider
*Attorney, Agent, or Firm*—Ernestine C. Bartlett

[57] ABSTRACT

A vacuum cleaner with a suction nozzle which is coupled to a handle on which a user of the vacuum cleaner can exert a pushing or pulling force for moving the suction nozzle over a surface to be cleaned. The suction nozzle is provided with an electrical drive for exerting a driving force on the suction nozzle, such that the pushing or pulling force to be exerted by the user is limited.

According to the invention, the vacuum cleaner comprises a detector capable of measuring the pushing or pulling force, exerted on the handle and an electrical controller for controlling the driving force as a function of the measured pushing or pulling force. The controller controls the driving force in such a manner, for example, that the measured pushing or pulling force remains substantially zero. It is thus possible for the user to move the suction nozzle effortlessly over the surface to be cleaned.

In a special embodiment, the handle is coupled to the suction nozzle by an elastically deformable coupling member, while the detector comprises a position sensor for measuring a position of the handle with respect to the suction nozzle.

16 Claims, 4 Drawing Sheets

VACUUM CLEANER PROVIDED WITH A SUCTION NOZZLE WITH CONTROLLABLE ELECTRICAL DRIVE MEANS

BACKGROUND OF THE INVENTION

The invention relates to a vacuum cleaner with a suction nozzle and a handle which is coupled to the suction nozzle during operation, said suction nozzle being provided with electrical drive means for exerting a driving force on the suction nozzle, while the vacuum cleaner comprises a detector by means of which at least a direction is controllable in which the drive means exert the driving force on the suction nozzle during operation.

In a known vacuum cleaner of the kind mentioned in the opening paragraph, the electrical drive means of the suction nozzle comprise an electric motor which is arranged in the suction nozzle for driving a set of drive wheels with which the suction nozzle rests on a surface to be cleaned during operation. The detector of the known vacuum cleaner comprises a switch having three positions which controls a direction of rotation of the motor and which is in contact with the surface to be cleaned during operation. If a user of the vacuum cleaner pushes the suction nozzle in a forward direction, the switch is forced into a first extreme position under the influence of the friction between the switch and the surface to be cleaned, in which position the motor drives the drive wheels with a substantially constant speed in a direction of rotation which corresponds to the forward direction. If the user pulls the suction nozzle in a backward direction, the switch is forced into a second extreme position under the influence of said friction, in which position the motor drives the drive wheels with a substantially constant speed in a direction of rotation corresponding to the backward direction. If the user keeps the suction nozzle in a fixed position on the surface, the switch is displaced to an intermediate position situated between said two extreme positions, in which the motor does not rotate. The electrical drive means thus exert a driving force on the suction nozzle via the drive wheels in a direction of movement of the suction nozzle desired by the user. A pushing or pulling force to be exerted on the handle by the user is considerably reduced thereby.

It is a disadvantage of the known vacuum cleaner that the drive wheels are driven with a substantially constant speed. As a result, the driving force delivered by the drive means will not lead to a speed of movement of the suction nozzle over the surf-ace to be cleaned desired by the user in many cases. If the user wishes to reverse the direction of movement of the suction nozzle, moreover, the user must initially displace the suction nozzle in the desired new direction of movement with a comparatively great pushing or pulling force until the switch is operated under the influence of the friction between the switch and the surface to be cleaned and the direction of rotation of the drive wheels corresponds to the desired new direction of movement. The ease of use of the known vacuum cleaner is adversely affected thereby.

SUMMARY OF THE INVENTION

It is an object of the invention to provide a vacuum cleaner of the kind mentioned in the opening paragraph in which the above disadvantages are avoided as much as possible, such that the ease of use of the vacuum cleaner is improved.

The vacuum cleaner according to the invention is for this purpose characterized in that a pushing or pulling force exerted by a user on the handle during operation is measurable by means of the detector, while the vacuum cleaner is provided with an electrical controller for controlling the driving force as a function of the measured pushing or pulling force. Since the driving force is controllable by means of the controller as a function of the pushing or pulling force exerted by the user on the handle during operation and measured by the detector, said driving force can be adapted in a predetermined manner to the pushing or pulling force exerted by the user. The driving force, for example, is comparatively great when the user exerts a comparatively great pushing or pulling force on the handle, and comparatively small when the user exerts a comparatively small pushing or pulling force on the handle, so that the driving force in most cases leads substantially immediately to a speed of movement of the suction nozzle over the surface to be cleaned which is desired by the user. A reversal of the direction of movement desired by the user can be detected immediately by the detector, so that the driving force can be immediately adapted to said reversal. The ease of use of the vacuum cleaner is substantially enhanced by this.

A special embodiment of a vacuum cleaner according to the invention is characterized in that the controller controls the driving force such that a value of the measured pushing or pulling force during operation does not rise above a predetermined value. If the user of this special embodiment of the vacuum cleaner according to the invention exerts a pushing or pulling force on the handle in a desired direction of movement, the drive means will exert a driving force on the suction nozzle in the desired direction of movement such that the pushing or pulling force does not rise above said predetermined value. The suction nozzle can thus be moved in a particularly effortless manner over the surface to be cleaned by the user, who will experience a certain contact force defined by said predetermined value during moving of the suction nozzle, which promotes the accuracy with which the suction nozzle is displaceable over the surface to be cleaned by the user.

A further embodiment of a vacuum cleaner according to the invention is characterized in that the controller controls the driving force such that the measured pushing or pulling force remains substantially zero during operation. Since the pushing or pulling force to be exerted on the handle by the user remains substantially zero, the user will indeed experience no contact force in this further embodiment of the vacuum cleaner according to the invention, but the suction nozzle can be displaced over the surface to be cleaned without any effort.

A yet further embodiment of a vacuum cleaner according to the invention is characterized in that the vacuum cleaner is provided with a first part which is coupled to the handle in a fixed position as seen parallel to a direction of movement of the suction nozzle, and with a second part which is coupled to the suction nozzle in a fixed position as seen parallel to the direction of movement, the first part being coupled to the second part by means of an elastically deformable coupling member and being displaceable relative to the second part at least parallel to the direction of movement, as a result of which the coupling member is deformed, while the detector comprises a position sensor for measuring a position of the first part with respect to the second part. If the first part is displaced relative to the second part in that the user exerts a pushing or pulling force on the handle, said coupling member will be deformed such that the coupling member exerts an elastic deformation force on the first part having a value corresponding to the value of the pushing or pulling force exerted by the user. Since the value of said deformation force is determined by the value of the displacement of the first part relative to the second part, the deformation force can be determined from the position of the first part relative to the second part measured by the position sensor. The pushing or pulling force exerted on the handle by the user can thus be measured in a simple manner through the use of said position sensor.

A special embodiment of a vacuum cleaner according to the invention is characterized in that the controller controls the driving force such that the first part is in a substantially constant position relative to the second part during operation, in which position the coupling member is substantially undeformed. If the user exerts a pushing or pulling force on the handle of this special embodiment of the vacuum cleaner according to the invention, such that the first part is displaced relative to the second part, the drive means will exert a driving force on the suction nozzle substantially immediately to the effect that the second part will follow the movement of the first part substantially entirely. Since the coupling member remains substantially undeformed in this manner, the user will experience substantially no reaction forces from the handle, so that the user can displace the suction nozzle over the surface to be cleaned without effort.

A further embodiment of a vacuum cleaner according to the invention is characterized in that the first part is displaceable relative to the second part from a position in which the coupling member is substantially undeformed in two mutually opposed directions which are parallel to the direction of movement. As a result of this, the coupling member is deformable from said undeformed position in both directions mentioned, so that pushing or pulling forces exerted on the handle in the two directions mentioned can be measured in a simple manner by means of the detector.

A yet further embodiment of a vacuum cleaner according to the invention is characterized in that the first part comprises the handle, while the second part comprises the suction nozzle and a tube positioned between the handle and the suction nozzle. In this further embodiment of the vacuum cleaner according to the invention, the coupling member and the detector are present adjacent the handle, so that displacements of the handle relative to the second part can be accurately measured.

A special embodiment of a vacuum cleaner according to the invention is characterized in that the first part comprises the handle and a tube arranged between the handle and the suction nozzle, while the second part comprises the suction nozzle. In this special embodiment of the vacuum cleaner according to the invention, the coupling member and the detector are present adjacent the suction nozzle, so that the drive means, the coupling member, the controller, and the detector are positioned at short distances from one another, and the coupling member, the controller, and the detector can be accordingly integrated into the suction nozzle.

BRIEF DESCRIPTION OF THE DRAWINGS

The invention will be explained in more detail below with reference to the drawing, in which.

DESCRIPTION OF THE PREFERRED EMBODIMENTS

Figure 1:
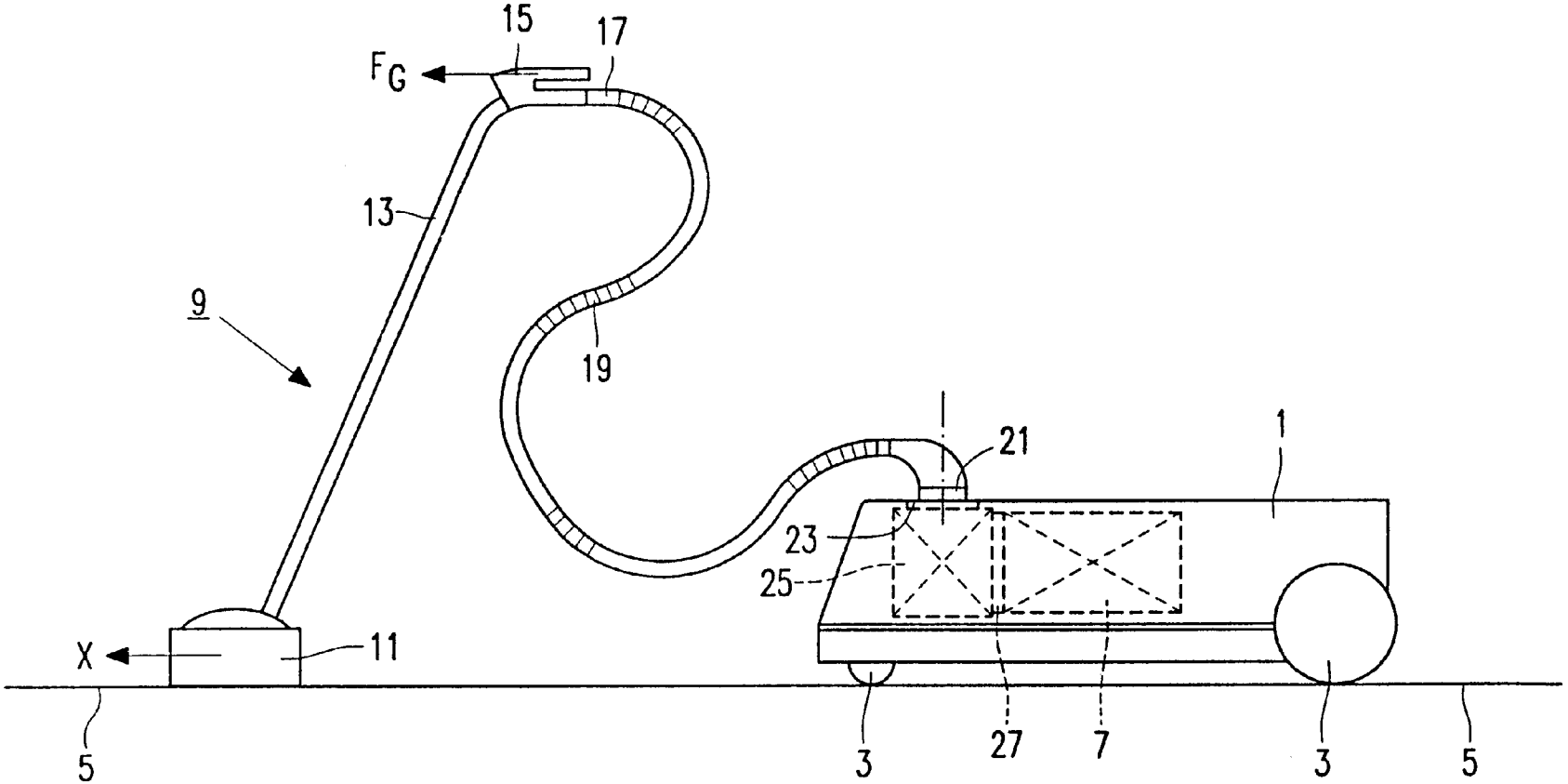
FIG. 1 shows a vacuum cleaner according to the invention, FIG. 2 diagrammatically shows a first embodiment of a suction attachment of the vacuum cleaner of FIG. 1, FIG. 3 diagrammatically shows a control system for the suction attachment of FIG. 2, and FIG. 4 diagrammatically shows a second embodiment of a suction attachment of the vacuum cleaner of FIG. 1.

The vacuum cleaner according to the invention shown in FIG. 1 is a so called floor-type (horizontal) vacuum cleaner comprising a housing 1 which is displaceable over a surface 5 to be cleaned by means of a number of wheels 3. An electrical suction unit 7, shown diagrammatically only in FIG. 1, is accommodated in the housing 1. The vacuum cleaner further comprises a suction attachment 9 which comprises a suction nozzle 11, a hollow tube 13, and a handle 15. The handle 15 is detachably coupled to a flexible hose 19 by means of a first coupling 17, while the flexible hose 19 is detachably coupled to a suction opening 23 provided in the housing 1 by means of a second coupling 21. The suction opening 23 issues into a dust chamber 25 of the housing 1 which is connected via a filter 27 to the suction unit 7. During operation, the suction unit 7 generates an underpressure in a suction channel which comprises the suction nozzle 11, the hollow tube 13, the flexible hose 19, the suction opening 23, and the dust chamber 25 of the vacuum cleaner. Dust and dirt particles present on the surface 5 to be cleaned are removed through the suction attachment 9 and the flexible hose 19 to the dust chamber 25 under the influence of said underpressure, for which purpose a user of the vacuum cleaner moves the suction nozzle 11 parallel to a direction of movement X over the surface 5 to be cleaned in that he or she exerts a pushing or pulling force $F_G$ on the handle 15 which is directed substantially parallel to the direction of movement X.

Figure 2:
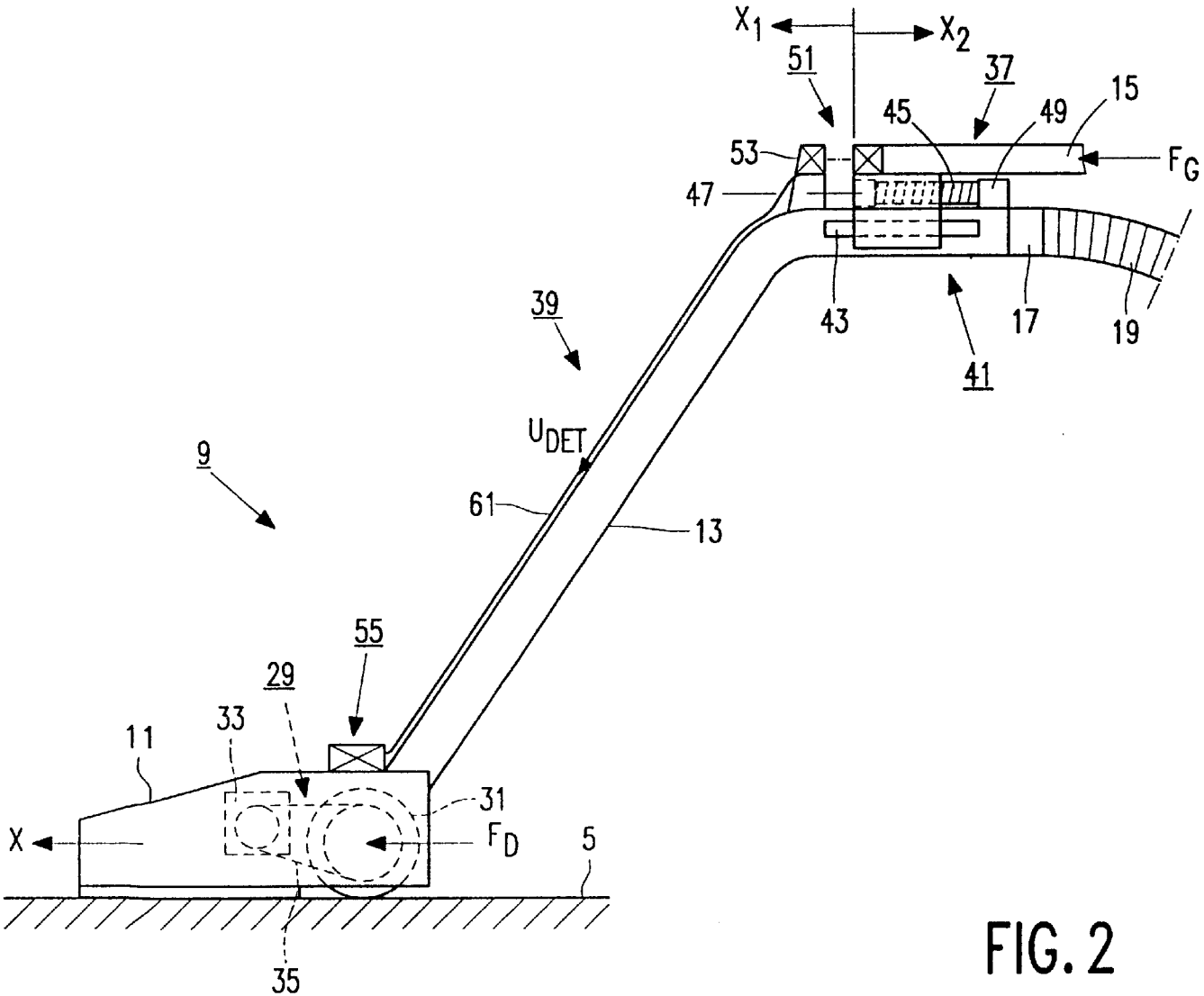

As FIG. 2 diagrammatically shows, the suction nozzle 11 of the suction attachment 9 comprises drive means 29 which comprise a pair of drive wheels 31 positioned next to one another, an electric motor 33 arranged in the suction nozzle 11 for driving the drive wheels 31, and a transmission 35 which is indicated diagrammatically only in FIG. 2. During operation, the drive wheels 31 are in contact with the surface 5 to be cleaned for exerting a driving force $F_D$ directed substantially parallel to the direction of movement X on the suction nozzle 11. Since the suction nozzle 11 is driven by the drive means 29 parallel to the direction of movement X during operation, the pushing or pulling force $F_G$ to be exerted on the handle 15 by the user is considerably reduced, whereby the ease of use of the vacuum cleaner is enhanced.

The value and the direction of the driving force $F_D$ of the drive means 29 are controlled in a manner to be described further below. As FIG. 2 diagrammatically shows, the suction attachment 9 in a first embodiment comprises a first part 37 comprising the handle 15, and a second part 39 comprising the suction nozzle 11 and the hollow tube 13. The first part 37 is coupled to the second part 39 by means of an elastically deformable coupling member 41 which is provided with a straight guide 43 and a mechanical helical spring 45. The first part 37 is displaceably guided relative to the second part 39 substantially parallel to the direction of movement X by means of the straight guide 43, the helical spring 45 being fastened between a first fastening block 47 fastened to the first part 37 and a second fastening block 49 fastened to the second part 39. The first part 37 is thus displaceable relative to the second part 39 parallel to the direction of movement X under elastic deformation of the helical spring 45. The suction attachment 9 further comprises a detector 51 by means of which a direction and a value of the pushing or pulling force $F_G$ exerted by the user on the handle 15 during operation can be measured. The detector 51 for this purpose comprises a position sensor 53 for measuring a position of the first part 37 relative to the second part 39. The position sensor 53, which is depicted diagrammatically only in FIG. 2, comprises, for example, a potentiometer, an optical position sensor, a capacitive position sensor, or a piezoelectrical position sensor, which are usual and known per se. When the user exerts a pushing or pulling force on the handle 15, the first part 37 is displaced with respect to the second part 39, whereby the helical spring 45 is deformed. As a result of this, the coupling member 41 exerts an elastic deformation force on the first part 37 with a value which corresponds substantially to the value of the pushing or pulling force exerted by the user and with a direction opposed to the direction of said pushing or pulling force. The value and the direction of said deformation force are determined by the position of the first part 37 relative to the second part 39, so that the deformation force can be determined from the position of the first part 37 relative to the second part 39 as measured by the position sensor 53. The pushing or pulling force can thus be measured in a simple and practical manner through the use of the helical spring 45 and the position sensor 53. Since the coupling member 41 and the detector 51 are positioned adjacent the handle 15, the pushing or pulling force exerted on the handle 15 is measured adjacent the handle 15, so that an accurate measurement of the pushing or pulling force is achieved.

The detector 51 of the suction attachment 9 discussed above forms part of a control system 55 of the suction attachment 9 by means of which a value and a direction of the driving force $F_D$ of the drive means 29 are controllable as a function of the pushing or pulling force $F_G$ measured by the detector 51 during operation. The control system 55 is diagrammatically shown in FIG. 3. An output signal $u_{DET}$ of the detector 51, which corresponds to a position of the first part 37 with respect to the second part 39 and accordingly to the pushing or pulling force $F_G$ exerted by the user on the handle 15, forms an input signal for an electrical controller 57 of the control system 55. The controller 57 is, for example, a PID controller which is usual and known per se and supplies an output signal $u_{REG}$ to an electrical amplifier 59 which is usual and known per se and which supplies the electric motor 33 of the drive means 29 with an electric current $i_M$ which is determined by the signal $u_{REG}$ and which determines the driving force $F_D$ delivered by the drive means 29. The driving force $F_D$ is thus controlled by the controller 57 in a predetermined manner as a function of the measured pushing or pulling force $F_G$. As FIG. 2 diagramatically shows, the control system 55 is mainly accommodated in the suction nozzle 11, the output signal $u_{DET}$ of the detector 51 being conducted through an electrical conductor 61 running alongside the tube 13 to the controller 57 mounted in the suction nozzle 11.

Figure 3:
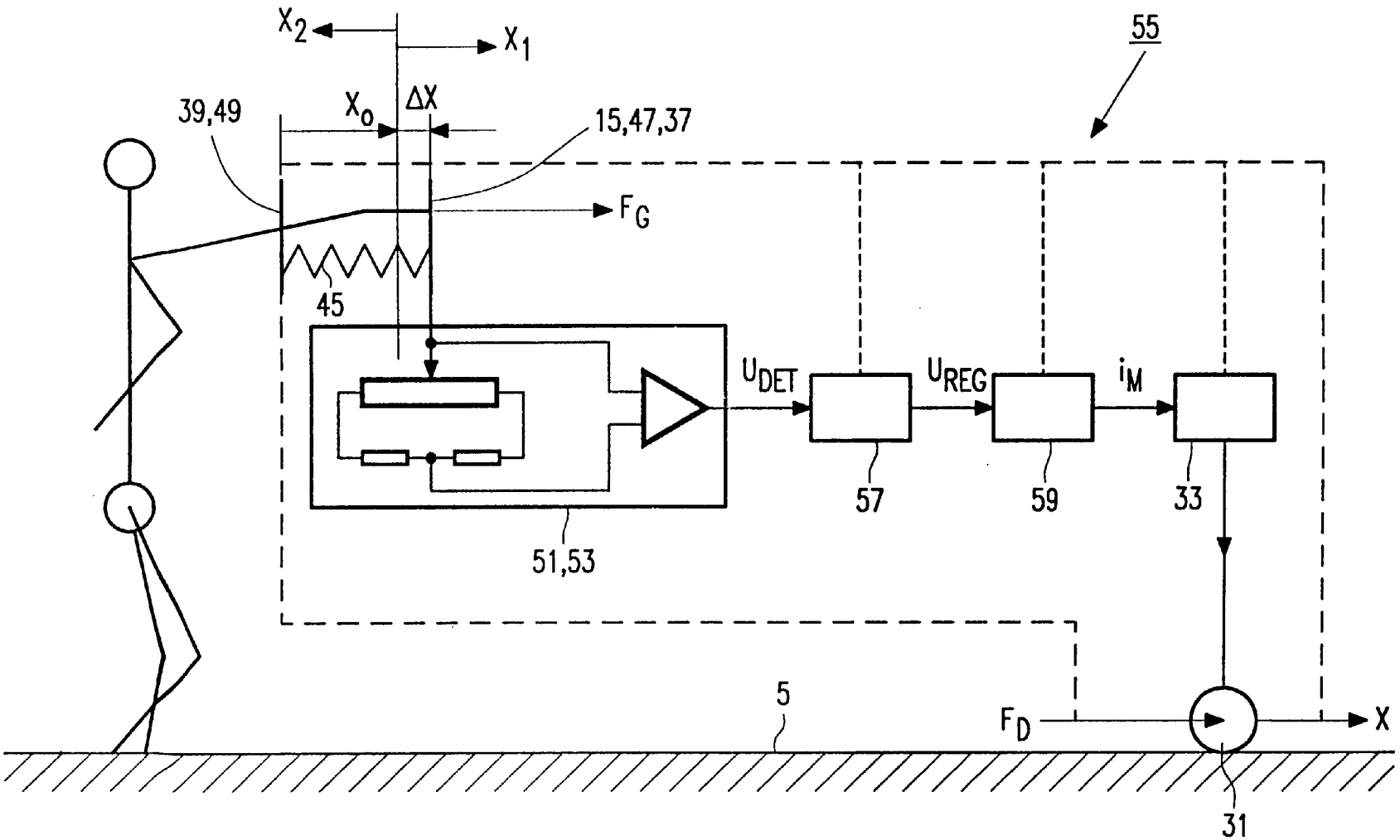

The controller 57 determines the signal $U_{REG}$ such that the output signal $u_{DET}$ of the detector 51 has a substantially constant reference value which corresponds to a reference position $x_0$ of the first part 37 relative to the second part 39, as shown diagrammatically in FIG. 3, wherein the helical spring 45 of the coupling member 41 is substantially undeformed. It is achieved in this manner that tie second part 39 with the suction nozzle 11 follows the first part 37 with the handle 15 as much as possible during operation, i.e. that the suction nozzle 11 is displaced as a result of the driving force $F_D$ such that the handle 15 relative to the suction nozzle 11 remains in a substantially constant position in which the helical spring 45 is unloaded. Since it is thus substantially impossible for the user to deform the helical spring 45 under normal operational conditions, the user will experience substantially no reaction forces arising from the handle 15, and the pushing or pulling force exerted by the user on the handle 15 remains substantially zero during operation. In this manner the suction nozzle 11 can be effortlessly displaced by the user over the surface 5 to be cleaned under normal operational conditions.

The first part 37 with the handle 15 is displaceable from the reference position $x_0$, in which the helical spring 45 is substantially undeformed, in two mutually opposed directions parallel to the direction of movement X relative to the second part 39, i.e. in a forward direction $X_1$ shown in FIGS. 2 and 3 and in a backward direction $X_2$, the helical spring 45 being deformable in both directions mentioned. It is thus possible by means of the detector 51 to measure both a pushing force in the forward direction and a pulling force in the backward direction. If the detector 51 detects a pushing force, in the forward direction, the controller 57 will control the motor 33 such that the drive means 29 supply a driving force in the forward direction. If the detector 51 detects a pulling force, in the backward direction, the controller 57 will control the motor 33 such that the drive means 29 supply a driving force in the backward direction. The fact that in this manner a reversal in the direction of the force exerted by the user, i.e. a reversal of the direction of movement of the suction nozzle 11 desired by the user, can be directly detected by the detector 51 renders the direction of the driving force of the drive means 29 directly adaptable to said reversal, so that handling of the vacuum cleaner can take place with a particularly high degree of comfort.

It is noted that the driving force of the drive means 29 according to the invention may be controlled by the controller 57 in an alternative manner. The driving force may be controlled, for example, such that the position of the first part 37 with respect to the second part 39 remains within a predetermined range during operation. It is achieved thereby that the value of the measured pushing or pulling force does not rise above a predetermined value. With such an embodiment of the controller, the user will experience a reaction force from the handle 15 which will not rise above said predetermined value. Said reaction force forms a contact force for the user which provides the user with feedback information on the movement carried out by the suction nozzle 11. Such a feedback promotes the accuracy with which the suction nozzle 11 can be displaced over the surface 5 to be cleaned by the user. Since the pushing or pulling force to be exerted by the user remains within said predetermined range, the suction nozzle 11 in such an embodiment of the controller can also be passed over the surface 5 to be cleaned without appreciable effort. The controller 57 may also control the driving force of the drive means 29, for example, such that the delivered driving force is substantially proportional to the measured pushing or pulling force, so that the driving force is comparatively great when the user exerts a comparatively great pushing or pulling force on the handle 15 and comparatively small when the user exerts a comparatively small pushing or pulling force on the handle 15. Since the driving force is thus controllable as a function of the measured pushing or pulling force, according to the invention, the driving force can be adapted in a predetermined manner to the measured pushing or pulling force, so that the driving force generated by the drive means 29 leads substantially immediately to a movement of the suction nozzle 11 over the surface 5 to be cleaned as desired by the user under normal operational conditions.

Figure 4:
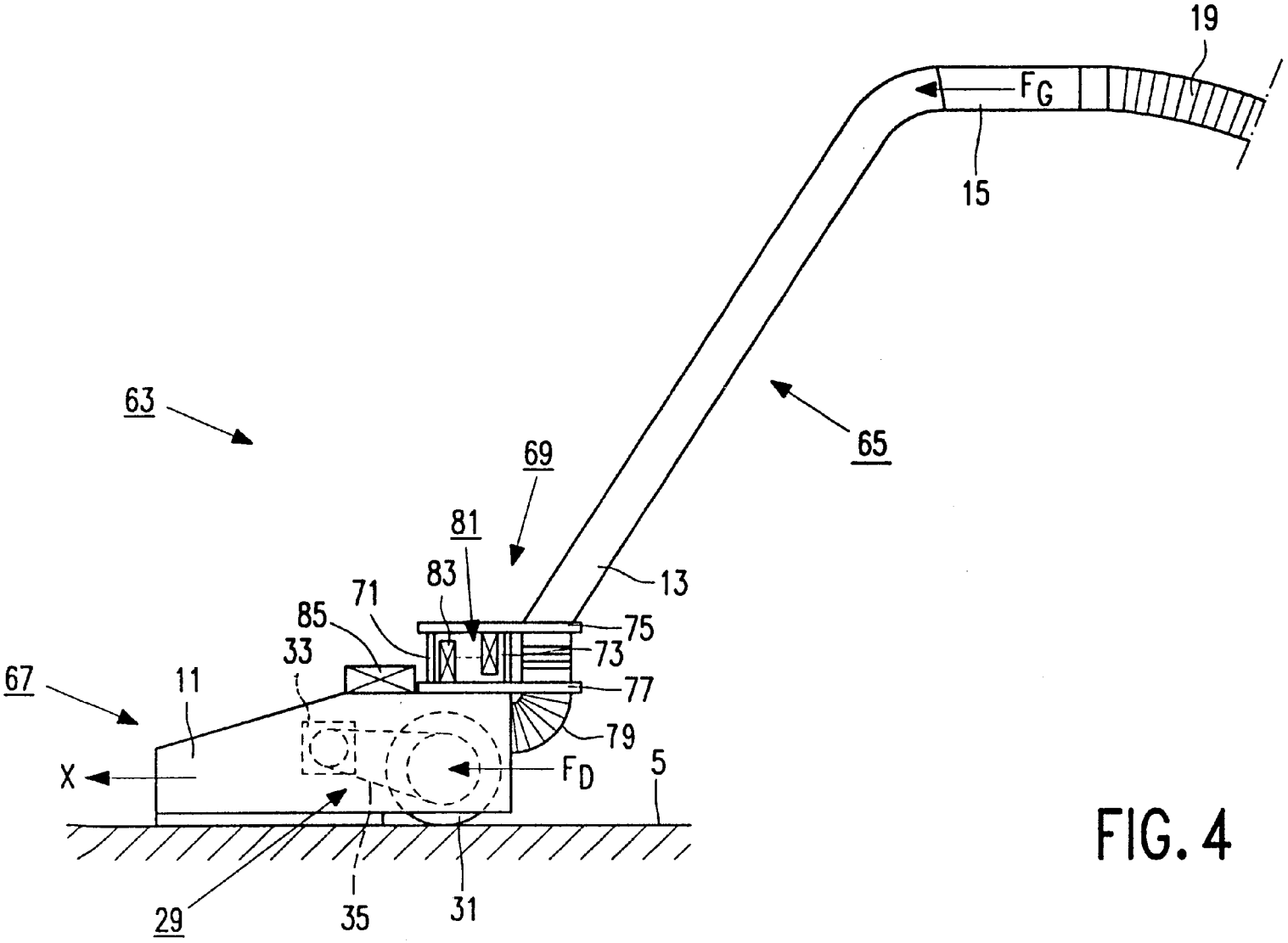

FIG. 4 diagrammatically shows a second embodiment of a suction attachment 63 for use in the vacuum cleaner according to the invention. Components of the suction attachment 63 corresponding to those of the suction attachment 9 discussed above have been given corresponding reference numerals in FIG. 4. As FIG. 4 shows, the suction attachment 63 comprises a first part 65 which comprises the handle 15 and the hollow tube 13, and a second part 67 which comprises the suction nozzle 11. The hollow tube 13 of the first part 65 is coupled to the suction nozzle 11 of the second part 67 by means of an elastically deformable coupling member 69 which is provided with two blade springs 71 and 73 which extend substantially perpendicularly to the direction of movement X. The blade springs 71 and 73 are fastened adjacent a first end to a fastening block 75 which is fastened to the hollow tube 13, and adjacent a second end to a fastening block 77 which is fastened to the suction nozzle 11. The hollow tube 13 is coupled to the section nozzle 11 by means of a flier flexible hose 79 which forms part of the suction channel of the vacuum cleaner. The use of said blade spring 71, 73 and said flexible hose 79 renders the first part 65 displaceable with respect to the second part 67 substantially parallel to the direction of movement X under elastic deformation of the two blade springs 71, 73. The suction attachment 63 further comprises a detector 81 by means of which a direction and a value of a pushing or pulling force $F_G$ exerted by the user on the handle 15 during operation can be measured. The detector 81 for this purpose comprises, as does the detector 51, a position sensor 83, which is usual and known per se, for measuring a position of the first part 65 with respect to the second part 67. When the user exerts a pushing or pulling force on the handle 15, the first part 65 is displaced relative to the second part 67, so that the blade springs 71 and 73 are bent parallel to the direction of movement X. As a result of this, the coupling member 69 exerts an elastic deformation force on the first part 65 with a value and a direction which are determined by the value and the direction of the pushing or pulling force exerted by the user. Since the value and the direction of said deformation force are determined by the position of the first part 65 relative to the second part 67, the deformation force can be determined from the position of the first part 65 relative to the second part 67 as measured by means of the position sensor 83. The pushing or pulling force can thus be determined in a simple and practical manner by means of the position sensor 83, as was the case with the suction attachment 9 discussed earlier. Since the coupling member 69 is at a comparatively large distance away from the handle 15, however, a static deformation of the blade springs 71, 73 occurring under the influence of the force of gravity acting on the hollow tube 13 and the handle 15 should be taken into account in determining the pushing or pulling force. Such a static deformation can be compensated for by mechanical or electronic means in a manner which is usual and known per se and which will not be explained in any detail here. The detector 81 forms part of a control system 85 of the suction attachment 63 by means of which a value and a direction of the driving force $F_D$ of the drive means 29 are controllable during operation in a manner corresponding to the manner in which the control system 55 discussed above controls the driving force of the suction attachment 9, or corresponding to an alternative method mentioned there. The control system 85, which corresponds substantially to the control system 55 discussed above, is not described in any detail here. As FIG. 4 diagrammatically shows, the control system 85 is accommodated in the suction nozzle 11. Since the coupling member 69 and the detector 81 are also arranged adjacent the suction nozzle 11, the coupling member 69, the detector 81, and the control system 85 can be integrated into the suction nozzle 11 in a simple and practical manner, whereby a simple and practical construction of the suction attachment 63 is provided.

The vacuum cleaners according to the invention described above are floor-type vacuum cleaners. It is noted that the invention also relates to upright vacuum cleaners, i.e. those in which a suction nozzle is coupled to a handle via a hollow tube, while a housing with a suction unit arranged therein is fastened to said tube.

It is further noted that the invention also relates to vacuum cleaners in which the handle 15 is detachably coupled to the hollow tube 13 by means of a further coupling. The invention accordingly relates to a vacuum cleaner with a suction nozzle 11 and a handle 15 which is coupled to the suction nozzle 11 during operation.

It is further noted that the invention also relates to vacuum cleaners in which the suction nozzle is provided with drive means of an alternative type. Thus the drive means 29 may be provided, for example, with caterpillar treads instead of the drive wheels 31 so as to prevent slip between the drive means and the surface to be cleaned as much as possible. Furthermore, the motor 33 of the drive means 29 may also be used, for example, for driving a brushing roller which is also accommodated in the suction nozzle.

In the vacuum cleaners according to the invention described above, the pushing or pulling force exerted on the handle 15 by the user during operation is measured in that the position of the first part 37, 65 with respect to the second part 39, 67 is measured by means of the detector 51, 81. It is noted that the vacuum cleaner according to the invention may also be provided with an alternative type of detector for measuring the pushing or pulling force such as, for example, a force sensor which is usual and known per se.

According to the invention, furthermore, an alternative type of controller may be used instead of the controller 57 in the control system 55, 85 described above, such as, for example, a digital controller or microprocessor which is usual and known per se.

In the first embodiment of the suction attachment 9 of the vacuum cleaner according to the invention as discussed above, the first part 37 of the suction attachment 9 comprises the handle 15, and the second part 39 of the suction attachment 9 comprises the suction nozzle 11 and the hollow tube 13, whereas in the second embodiment of the suction attachment 63 the first part 65 comprises the handle 15 and the hollow tube 13, and the second part 67 comprises the suction nozzle 11. It is noted that the elastically deformable coupling between the first part and the second part according to the invention may be provided in an alternative location. The invention accordingly covers any alternative embodiment in which the handle 15 is coupled to the first part in a fixed position as seen parallel to the direction of movement of the suction nozzle 11, and the suction nozzle 11 is coupled to the second part in a fixed position as seen parallel to the direction of movement. Instead of the coupling members 41 and 69 discussed above, an alternative elastically deformable coupling member may then be used between the first part and the second part.

What is claimed is:

1. A vacuum cleaner which comprises: a suction nozzle and a handle which is coupled to the suction nozzle durinrg operation, said suction nozzle being provided with electrical drive means for exerting a driving forte on the suction nozzle, a detector by means of which at least a direction is controllable in which the drive means exert the driving force on the suction nozzle during operation, and an electrical controller for controlling the drive means, wherein a pushing or pulling force exerted by a user on the handle during operation is measurable by the detector, the electrical controller controlling the driving force as a function of the measured pushing or pulling force.

2. A vacuum cleaner as claimed in claim 1, wherein the controller controls the driving force such that a value of the measured pushing or pulling force during operation does not rise above a predetermined value.

3. A vacuum cleaner as claimed in claim 2, wherein the vacuum cleaner is provided with a first part which is coupled to the handle in a fixed position as seen parallel to a direction of movement of the suction nozzle, and with a second part which is, coupled to the suction nozzle in a fixed position as seen parallel to the direction of movement, the first part being coupled to the second part by means of an elastically deformable coupling member and being displaceable relative to the second part at least parallel to the direction of movement, as a result of which the coupling member is deformed, the detector comprising a position sensor for measuring a position of the first part with respect to the second part.

4. A vacuum cleaner as claimed in claim 2, wherein the controller controls the driving force such that the measured pushing or pulling force remains substantially zero during operation.

5. A vacuum cleaner as claimed in claim 4, wherein the vacuum cleaner is provided with a first part which is coupled to the handle in a fixed position as seen parallel to a direction of movement of the suction nozzle, and with a second part which is coupled to the suction nozzle in a fixed position as seen parallel to the direction of movement, the first part being coupled to the second part by means of an elastically deformables coupling member and being displaceable relative to the second part at least parallel to the direction of movement, as a result of which the coupling member is deformed, the detector comprising a position sensor for measuring a position of the first part with respect to the second part.

6. A vacuum cleaner claimed in claim 5, wherein the controller controls the driving force such that a first part is in a substantially constant position relative to the second part during operation, in which position the coupling member is substantially undeformed.

7. A vacuum cleaner as claimed in claim 1, wherein the vacuum cleaner is provided with a first part which is coupled to the handle in a fixed position as seen parallel to a direction of movement of the suction nozzle, and with a second part which is coupled to the suction nozzle in a fixed position as seen parallel to the direction of movement, the first part being coupled to the second part by means of an elastically deformable coupling member and being displaceable relative to the second part at least parallel to the direction of movement, as a result of which the coupling member is deformed, the detector comprising a position sensor for measuring a position of the first part with respect to the second part.

8. A vacuum cleaner as claimed in claim 7, wherein the controller controls the driving force such that the first part is in a substantially constant position relative to the second part during operation, in which position the coupling member is substantially undeformed.

9. A vacuum cleaner as claimed in claim 8, wherein the first part is displaceable relative to the second part from a position in which the coupling member is substantially undeformed in two mutually opposed directions which are parallel to the direction of movement.

10. A vacuum cleaner as claimed in claim 9, wherein the first part comprises the handle, while the second part comprises the suction nozzle and a tube positioned between the handle and the suction nozzle.

11. A vacuum cleaner as claimed in claim 9, wherein the first part comprises the handle and a tube arranged between the handle and the suction nozzle, while the second part comprises the suction nozzle.

12. A vacuum cleaner as claimed in claim 8, wherein the first part comprises the handle, while the second part comprises the suction nozzle and a tube positioned between the handle and the suction nozzle.

13. A vacuum cleaner as claimed in claim 8, wherein the first part comprises the handle and a tube arranged between the handle and the suction nozzle, while the second part comprises the suction nozzle.

14. A vacuum cleaner as claimed in claim 7, wherein the first part is displaceable relative to the second part from a position in which the coupling member is substantially undeformed in two mutually opposed directions which are parallel to the direction of movement.

15. A vacuum cleaner as claimed in claim 7, wherein the first part comprises the handle, while the second part comprises the suction nozzle and a tube positioned between the handle and the suction nozzle.

16. A vacuum cleaner as claimed in claim 7, wherein the first part comprises the handle and a tube arranged between the handle and the suction nozzle, while the second part comprises the suction nozzle.

* * * * *